United States Patent [19]

Miller

[11] 4,318,667

[45] Mar. 9, 1982

[54] ACTUATING MECHANISM FOR FLUID PUMP INLET CLOSURE VALVE

[75] Inventor: Edwin K. Miller, Rockford, Ill.

[73] Assignee: Sundstrand Corporation, Rockford, Ill.

[21] Appl. No.: 79,638

[22] Filed: Sep. 27, 1979

[51] Int. Cl.[3] ..... F01D 15/10

[52] U.S. Cl. ..... 415/121 R; 417/360

[58] Field of Search ..... 417/360, 361; 415/157, 415/158, 168, 121 R; 222/333, 385

[56] References Cited

U.S. PATENT DOCUMENTS

| | | | |
|---|---|---|---|
| 2,381,834 | 8/1945 | Meredew et al. | 417/360 |
| 2,384,254 | 9/1945 | Meredew | 417/360 |
| 2,420,315 | 5/1947 | Holt et al. | 222/385 |
| 2,978,150 | 4/1961 | Doelcher | 222/333 |
| 3,000,543 | 9/1961 | Paul | 222/333 |
| 3,064,340 | 11/1962 | Green | 29/240 |
| 3,172,365 | 3/1965 | Nasvytis | 417/360 |
| 3,453,964 | 7/1969 | Hallworth | 417/360 |
| 3,539,272 | 11/1970 | Howard et al. | 415/168 |
| 3,963,381 | 6/1976 | Kohnen | 417/360 |
| 3,973,868 | 8/1976 | Weisser | 415/157 |

FOREIGN PATENT DOCUMENTS

| | | | |
|---|---|---|---|
| 976638 | 12/1964 | United Kingdom | 417/360 |
| 1223997 | 3/1971 | United Kingdom | 417/360 |

*Primary Examiner*—Robert E. Garrett

*Attorney, Agent, or Firm*—Ted E. Killingsworth; Michael B. McMurry; Harold A. Williamson

[57] ABSTRACT

This invention relates to an actuating mechanism for a pump inlet closure valve and includes in combination a pump housing which projects into a fuel tank and has an opening to allow passage of fuel from the tank into the pump housing. A pump inlet closure valve sleeve is positioned within the pump housing and is mounted for movement in a predetermined path. A pump is positioned within the valve sleeve. A fixed pump housing seal is located in the path of the valve sleeve as well as within and between the pump and the housing. A valve actuating mechanism includes a handle which is pivotally secured to the pump housing and slideably moveable in a direction parallel to the path of the valve sleeve. The handle is mechanically coupled to the valve sleeve whereby initial manual movement of the handle causes the valve sleeve to move into a position blocking the opening to the fuel tank. The valve sleeve is locked in place during subsequent pivotal movement of the handle, which movement allows for the unobstructed passage of the pump from the housing.

20 Claims, 5 Drawing Figures

ACTUATING MECHANISM FOR FLUID PUMP INLET CLOSURE VALVE

TECHNICAL FIELD

This invention relates to an actuating mechanism for a fluid pump inlet closure valve.

BACKGROUND ART

Historically, cartridge or plug-in pumps have been employed in those environments where the pump is housed within the confines of a tank or receptacle containing fluid to be delivered under pressure remote from the tank or receptacle. These cartridge or plug-in pumps, as they are frequently called, are so designed as to permit their ready removal from the tank or receptacle for replacement or repair. The pumps may be primary sources of fluid under pressure, or they may function as boost pumps to deliver the fluid from the tank or receptacle to another pump for final delivery to a system end use.

In an aircraft environment these pumps are located on the bottom surface of the fuel tanks to allow access from below, as well as ensure that all fuel resting on the bottom of the tank is drawn off by the pump for its ultimate intended use.

The fuel tanks may be at varying levels of fullness and the removal of the pump must be effected without the requirement of draining the fuel tank. A number of inventions have recognized the basic problem of pump removal with a concomitant need for sealing off the fuel tank from the pump housing to allow pump removal without the requirement of first draining the fuel tank.

The Paul U.S. Pat. No. 3,000,543 provides a plug-in pump assembly which has a pump and motor "D" surrounded by a slideable sleeve 26 which sleeve 26 has an opening 47 that allows fuel from a tank "T" to pass into a pump inlet 12 of the pump and motor combination "D." The sleeve 26 is secured for sliding movement with the pump and motor "D," such that the sleeve 26 and its opening are moved to a position where the housing of the fuel tank obstructs the flow of fuel from the tank "T" to the pump and motor "D." Subsequent rotation and then downward movement of the pump and motor "D" allow for its removal.

In the Howard et al U.S. Pat. No. 3,539,272, there is disclosed a rotatable valve member 66 provided for closing off a fuel passage or inlet 46 from a fuel tank 10 prior to withdrawal of a pump and motor assembly 30. The valve member 66 is manually rotatable after removal of a closure plate 130 covering the pump end of the pump and motor assembly 30.

Inherent in both of these patents is the need for some sequential steps in the removal of a pump to assure that removal of the pump will not inadvertently allow the fuel in the tank to escape through the tank opening in which the pump is removed. The prior art does not include any means to insure that a valve which closes off a fuel passage to the pump is locked in place prior to removal of the pump. In addition, the prior art makes no provision to preclude fuel pump drainage, until a valve which closes a fuel passage to the pump is locked in place.

The invention to be described more fully hereinafter provides an even greater measure of security than the apparatus of the prior art in a simple yet expeditious manner.

DISCLOSURE OF INVENTION

The present invention relates to an actuating mechanism for a cartridge boost pump inlet closure valve used in an aircraft fuel tank. The closure valve and its actuating mechanism include in combination a pump housing which projects into the fuel tank and is integral therewith. The pump housing has an opening to allow passage of fuel from the tank into the pump housing. A pump closure valve sleeve is positioned within the pump housing and is mounted for movement in a predetermined path. A pump is positioned within the valve sleeve. A fixed pump housing seal is located in the path of the closure valve sleeve as well as within and between the pump and the housing. A pump closure valve actuating mechanism includes a handle which is pivotally secured to the pump housing and slideably moveable in a direction parallel to the path of the valve sleeve. The handle is mechanically coupled to the valve sleeve whereby initial manual movement of the handle causes the valve sleeve to move into a position blocking the opening to the fuel tank, whereupon subsequent pivotal movement of the handle allows for the unobstructed passage of the pump from the housing.

It is, therefore, a primary object of this invention to provide an actuating mechanism for locking closed a cartridge pump inlet closure valve for a pump used in an aircraft fuel tank and further allows for the safe and easy installation or removal of the cartridge from the fuel tank without the loss of fuel from the tank.

Another object of the invention is to provide a pump inlet closure valve in which its actuating mechanism includes a handle that must be pulled first in one direction and then turned or pivoted in a second direction to thereby sequentially place the inlet closure valve in a closed position and thereafter allow the pump to be freed for ready removal.

A further object of the invention is to provide an inlet closure valve actuating mechanism of a configuration that uniquely precludes the opening of a pump drain plug until the closure valve actuating mechanism has been consecutively moved to first close an inlet from the fuel tank to the pump and then moved to a position that will allow ready access and easy removal of the pump drain plug to thereby allow only the residual fuel within the pump to be drained.

A final object of the invention is to provide in combination with an actuating mechanism for a pump inlet closure valve a releasable seal positioned within a pump housing such that when the inlet closure valve has been closed by the actuating mechanism, the seal simultaneously provides a limit stop for closure valve movement and a final seal to preclude any fuel leakage from a tank or receptacle in which the invention is employed.

In the attainment of the foregoing objects, the invention includes in combination an actuating mechanism for a pump inlet closure valve of a plug-in fuel boost pump mounted on the bottom of an aircraft fuel tank. The combination includes a pump housing projecting into the tank and integral therewith. The pump housing has an opening to allow passage of fuel from the tank into the pump housing. A pump inlet closure valve sleeve is positioned within the pump housing and is mounted for movement in a predetermined path. The pump is positioned within the pump closure valve sleeve. A fixed pump housing seal is located within and between the pump and the pump housing. The pump housing seal is positioned in the path of the pump closure valve sleeve and acts as a limit stop for the valve sleeve's travel. The closure valve actuating mechanism has a handle pivotally secured to the pump housing and slideably moveable in a direction parallel to the given path. The handle is mechanically coupled to the valve sleeve by a plurality of bars or rods secured at one end to the pump closure valve sleeve. The other end of the shafts have head elements which are mechanically secured to the handle. The handle, shafts and valve sleeve are initially moved in unison until the valve sleeve is in a position blocking the opening to the fuel tank. After the initial movement, the handle can then be moved pivotally so that the pump can be removed from the housing unobstructed by the handle. The valve sleeve actuating mechanism further includes a spring between the handle and the housing to bias the handle towards the housing. The handle itself is secured at one end to a tubular shaft that is mounted for sliding movement in the housing. The tubular shaft for the handle includes a key on its outer surface, which key slidingly cooperates with a groove in the housing during the initial movement of the handle, tubular shaft and valve sleeve. The key is free of the groove during pivotal movement of the handle.

The pump includes a discharge drain plug, and the handle is positioned in a manner such that access to the drain plug can only be obtained after the handle has been moved and then fully pivoted to thereby insure that the pump closure valve is in the fuel passage blocking position and that only residual fluid in the pump is allowed to escape should the drain plug be removed.

Other objects and advantages of the present invention will become apparent from the ensuing description and the illustrative embodiment thereof, in the course of which, reference is made to the accompanying drawings in which:

BEST MODE FOR CARRYING OUT THE INVENTION

Figure 1:
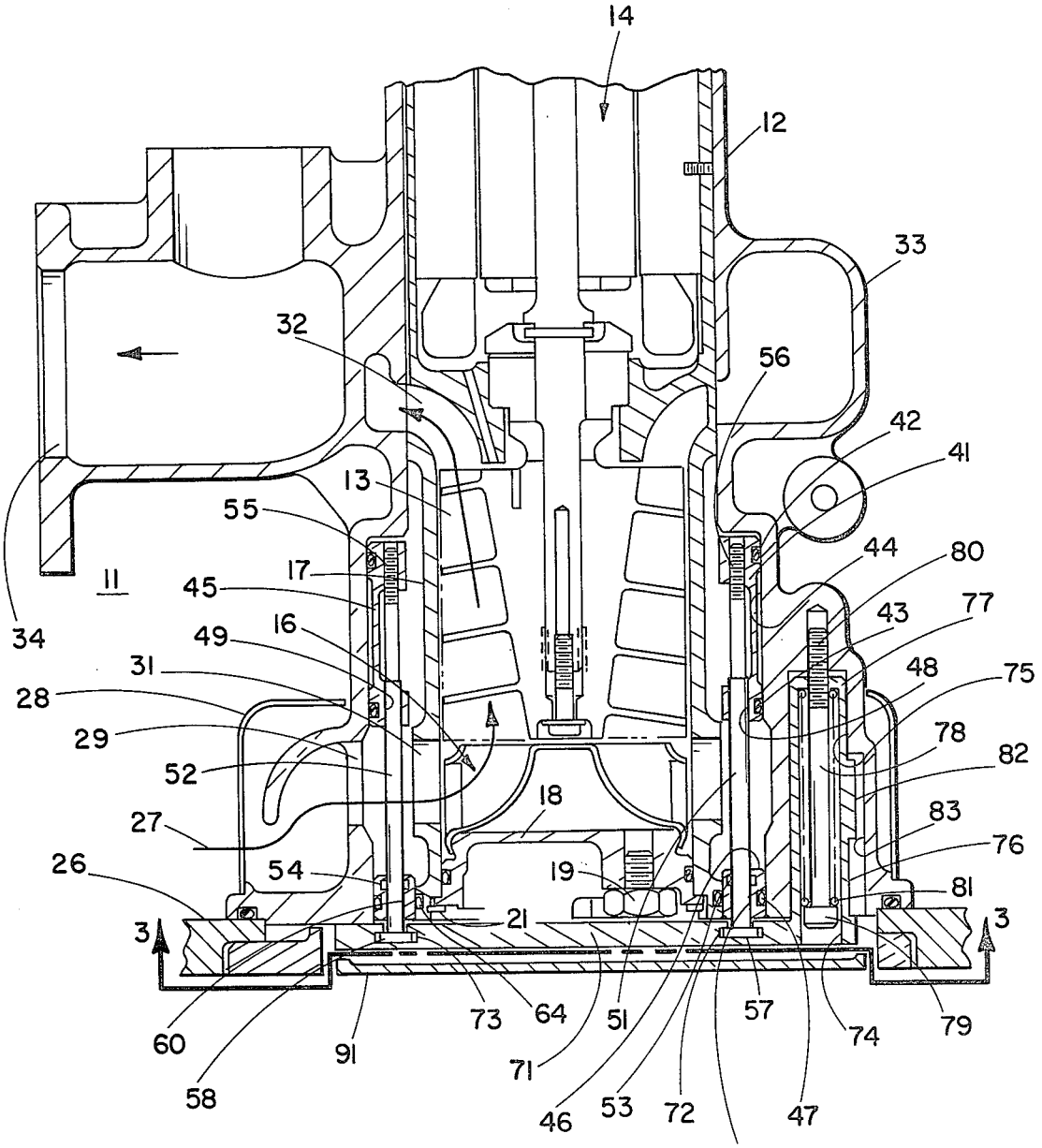
FIG. 1 is a cross sectional illustration of a plug-in fuel boost pump with associated inlet closure valve and closure valve actuating mechanism of the invention.

Reference is now made to FIG. 1 which illustrates a cross section of a plug-in or cartridge-type pump having an electric motor 14 generally indicated, a rotary impeller 13 and a guide vane 16 housed within a cylindrical pump cartridge 17. The guide vane 16 is integrally secured to a pump drain plate 18 which has a drain plug 19 as shown. The drain plate 18 is held in place by a split ring retainer 21. The cartridge 17 is, in turn, fitted within a generally cylindrical pump housing 12. The pump housing 12 is only partially shown as is the motor 14. The electrical connections for the motor 14 are not shown as this feature forms no part of the invention presently being described. A fuel tank 11 surrounds the housing 12, and the housing 12 is secured by means not shown to the fuel tank bottom 26.

The pump housing 12 has a fuel inlet passage or opening 29 which allows fuel to be drawn from the fuel tank 11 past a screen 28 and a pump inlet opening 31 in cylindrical cartridge 17 whenever the motor 14 and impeller 13 are in operation. A fuel flow arrow 27 shows the path the fuel will take when the pump is in operation. The fuel drawn into the pump will be delivered to a cartridge outlet 32 which communicates with a conventional scroll-shaped discharge chamber 33 formed integrally with the pump housing 12. The fuel so pumped is delivered to a discharge port 34 which in turn is connected by conduits not shown to other apparatus where the fuel is used.

Referring to FIG. 1, a pump inlet closure valve sleeve 41, which will be referred to hereinafter as valve sleeve 41, is shown positioned between the pump housing 12 and the cartridge 17. The valve sleeve 41 is mounted in sliding contact with the inner wall 44 of the housing 12. The valve sleeve 41 can slide axially downward along a predetermined path to a final position as can best be seen in FIG. 2. When the valve sleeve 41 is in the position shown in FIG. 2, the fluid passageway between the opening 29 of the pump housing 12 and the cartridge inlet 31 is blocked by the physical presence of the valve sleeve midsection 45.

The valve sleeve 41 has "O" ring seals 42,43 which provide a fluid tight fit between the valve sleeve 41 and the inner wall 44 of pump housing 12.

At the bottom of the inner fuel tank housing 12, as it is shown in FIG. 1, there is a ring stop member 46 which has an "O" ring seal 47 as shown between the ring stop member and the inner wall 44 of the inner fuel tank housing 12. The manner in which the ring stop is held in place will be explained hereinafter. It is sufficient to note at this point that the ring stop member 46 is securely connected to the housing 12 and this connection acts as a limit stop and precludes the valve sleeve 41 from traveling beyond a point defined by the position of the ring stop member 46. An "O" ring seal 64 on the outer periphery of cartridge 17 engages the inner surface of the ring stop member when the pump is in place.

The ring stop member 46 has a pair of openings 60,61 which are in alignment with a pair of openings 48,49 in the lower portion of valve sleeve 41. A pair of shafts or drawbars 51,52 are shown passing respectively through openings 61 and 48 of the ring stop member 46 and valve sleeve 41 and through openings 60 and 49 of the ring stop member 46 and valve sleeve 41.

The shafts 51,52 have threaded portions 56,55 shown secured to the valve sleeve 41. The ends of the shafts 51,52 opposite the threaded ends 56,55 have, respectively, head elements 57,58.

Figure 2:
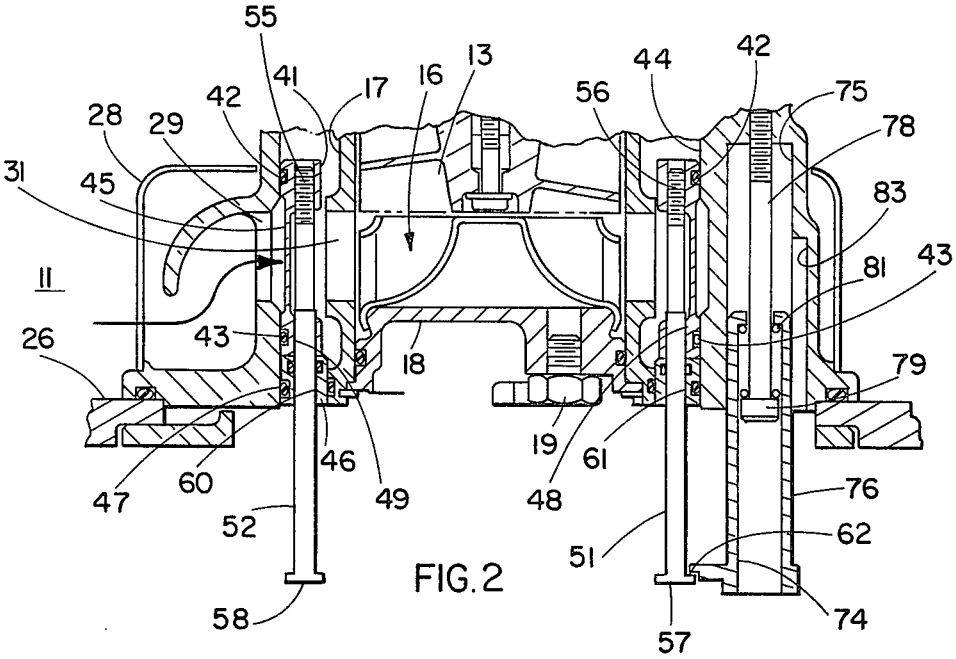
FIG. 2 is a partial section showing the inlet closure valve and valve actuating mechanism in a valve closed and locked position.
Figure 3:
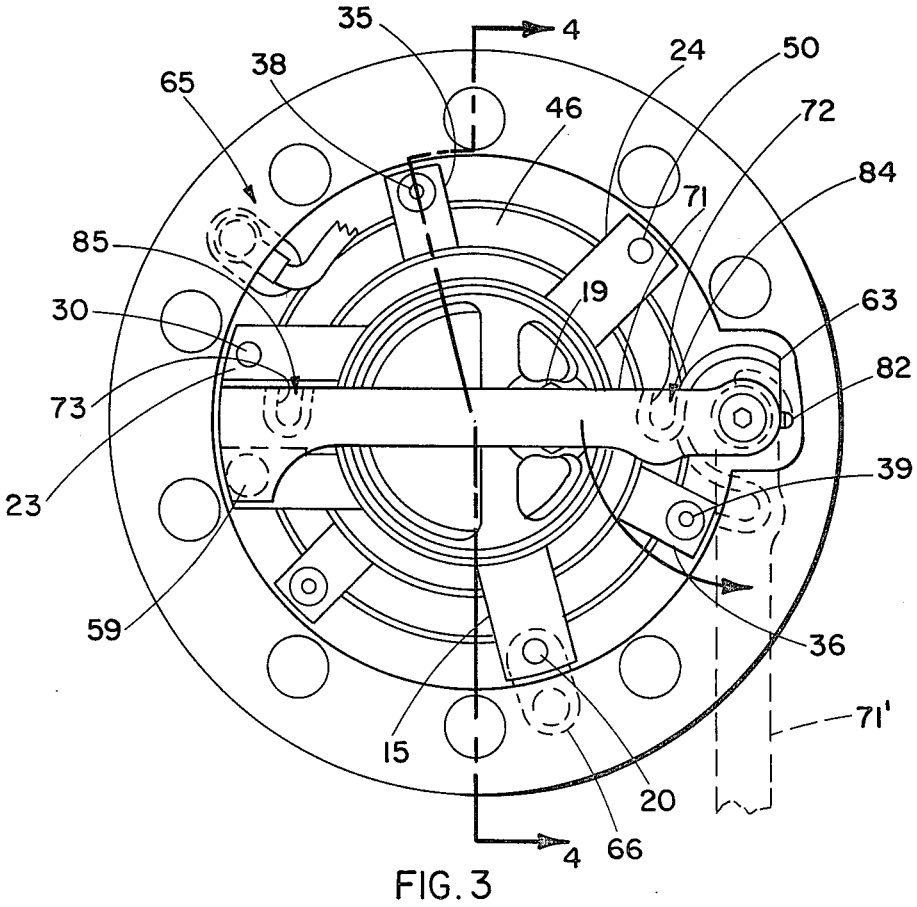
FIG. 3 is a view taken along the line 3—3 of FIG. 1.

A handle 71 shown at the bottom of FIG. 1 and better seen in FIG. 3 has a pair of slotted openings 72,73 into which the head elements 57,58 respectively fit. The handle 71 can be moved axially in the direction of shafts 51,52 from the position of FIG. 1 to the position of FIG. 2, and then the handle can be pivotally moved from the fuel line position in FIG. 3 into the position shown in dotted outline in FIG. 3. The cooperation of the handle 71 and its slots 72,73 with the head elements 57,58 will be explained in greater detail hereinafter.

Returning now to FIG. 1, it can be seen that the handle 71 has at its right hand end as FIG. 1 is viewed here, a tubular shaft 76 that projects upwardly into an opening 75 formed in the housing 12. The tubular shaft 76 fits in a mating relationship with the opening 75. The tubular shaft 76 has a central bore 74 which terminates at its upper end with an annular inwardly disposed lip 77.

A pivot bolt 78 is shown positioned centrally within and passing through the bore 74 of the tubular shaft 76. The pivot bolt 78 has at its upper end a threaded portion 80 which engages a threaded portion (not referenced) of the housing 12. The pivot bolt 78 has a head 79, and positioned around the pivot bolt 78 and between the head 79 and the annular lip 77 is a coiled spring 81. It should be apparent that the position of the spring 81 and its physical relationship to the pivot bolt 78 and tubular shaft 76 allows the spring 81 to experience compression when the handle shaft 76 is moved axially from the position of FIG. 1 to the position shown in FIG. 2. The spring 81 is normally installed under compression and acts to bias the handle 71 and its associated tubular shaft 76 in a direction towards the fuel tank bottom 26 and the pump cartridge drain plate 18.

The tubular shaft 76 has on its outer surface a key element 82 which fits into a groove 83 located in the opening 75 in housing 12. The key 82 and groove 83 mechanically cooperate to allow the tubular shaft 76 to move in a reciprocating manner in the constraints defined by the sides of the groove and the length of the groove.

Reference is now made specifically to FIG. 2 which depicts the lower region of FIG. 1 in partial section. This FIG. 2 shows the inlet closure valve and the valve actuating mechanism of the invention in a closed and locked position. The operation and cooperation of the elements shown in FIG. 2 can best be understood if studied in conjunction with the illustration of FIG. 3, which represents a bottom view of the apparatus of FIG. 1 with cover 91 removed.

The handle 71 as seen in FIG. 3 when pivoted or rotated to the position shown in dotted outline 71 will provide the cross section depicted in FIG. 2. In FIG. 2 the handle has been pulled downward as FIG. 2 is viewed and then rotated through approximately 90°. The downward movement of handle 71 causes the drawbar or shafts 51,52 to also be moved downward due to the mechanical cooperation of shaft head elements 57,58 with slotted openings 72,73 of handle 71 best seen by reference to FIG. 1 and FIG. 3. The slots 72,73 are open at points 84,85 so as to permit engagement of the head elements 57,58 only when the handle 71 is turned in a clockwise direction as viewed in FIG. 3. The handle 71 when viewed in FIG. 3 can be seen to include a stepped guide land 63 which cooperates with the underside 62 of head element 57.

The key 82 cannot be seen in FIG. 2 due to the fact that the handle 71 has been pulled downward until the key 82 clears the groove 83 and then the handle 71 with tubular shaft 76 and associated key 82 have been rotated or pivoted to the position shown in dotted outline in FIG. 3. The handle 71 cannot be rotated until it has been pulled completely down so that the aforementioned valve sleeve 41 has come into contact with ring stop member 46. When valve sleeve 41 is in this position, the fuel inlet passage or opening 29 is blocked by valve sleeve midsection 45.

With the valve sleeve 41 in the position just explained and shown illustrated in FIG. 2, it can be seen that the valve sleeve 41 and its "O" ring seal 43 in conjunction with the "O" ring seal 47 of ring stop seal member 46 provide an effective seal to preclude fuel from the tank 11 escaping when the cylindrical plug-in pump cartridge 17 is subsequently removed. The "O" ring seal 42 near the top of the valve sleeve also seals inlet opening 29.

Figure 4:
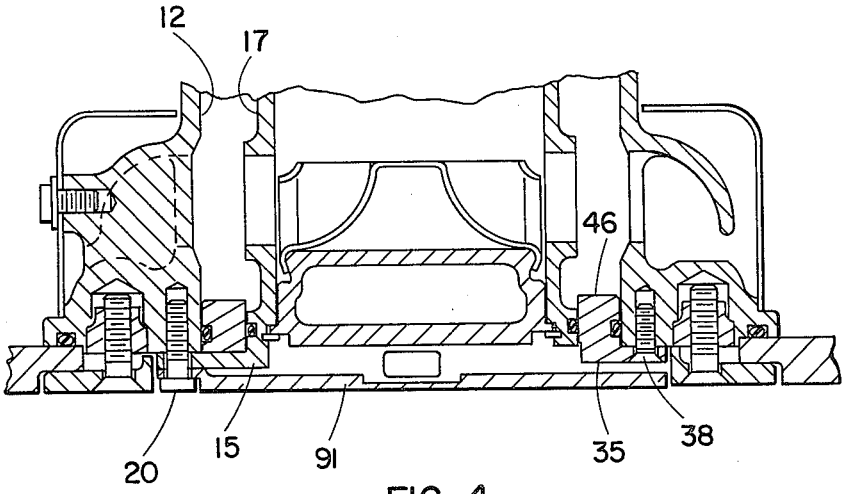
FIG. 4 is a section taken along line 4—4 in FIG. 3.

FIG. 2 also clearly shows coil spring 81 in compression due to the downward movement of the handle 71 therein depicted. The ring stop member 46 as seen in FIG. 2 is secured to a portion of the housing 12 by means of mounting tabs 35, 36 and 37 and screws 38, 39 and 40. FIG. 4 shows one such screw 38 in section. It will be noted that in FIG. 4 due to the nature of the section taken along line 4—4 in FIG. 3, this figure does not show the valve sleeve 41 or any of the valve sleeve actuating mechanism.

It will be appreciated when FIG. 3 is examined that the stepped guide land 63 will always remain in a mechanical coupling with head element 57 during and after rotation of the handle thereby ensuring that the handle 71 and its mechanical connection via shaft 51 and the sleeve valve 41 is always maintained. The handle 71 can also be equipped with a detent mechanism (not shown) to insure that the handle 71 is not inadvertently rotated after the handle 71 has been rotated to effect valve sleeve 41 closing of inlet fuel passage opening 29.

Turning now to FIG. 4, a cylindrical pump cartridge 17 is shown having a mounting lug 15 secured to the housing 12 by means of a bolt 20 at its lower end as viewed in FIG. 4. In FIG. 3 it can be seen that in addition to mounting lug 15 for pump housing 17, there are mounting lugs 22, 23 and 24. Three of the mounting lugs; namely 15, 23 and 24 are secured to the housing 12 by means of bolts 20, 30 and 50 which bolts 20, 30 and 50 also pass through cover 91. In FIG. 4 bolt 20 is shown passing through cover 91 and lug 15.

Figure 5:
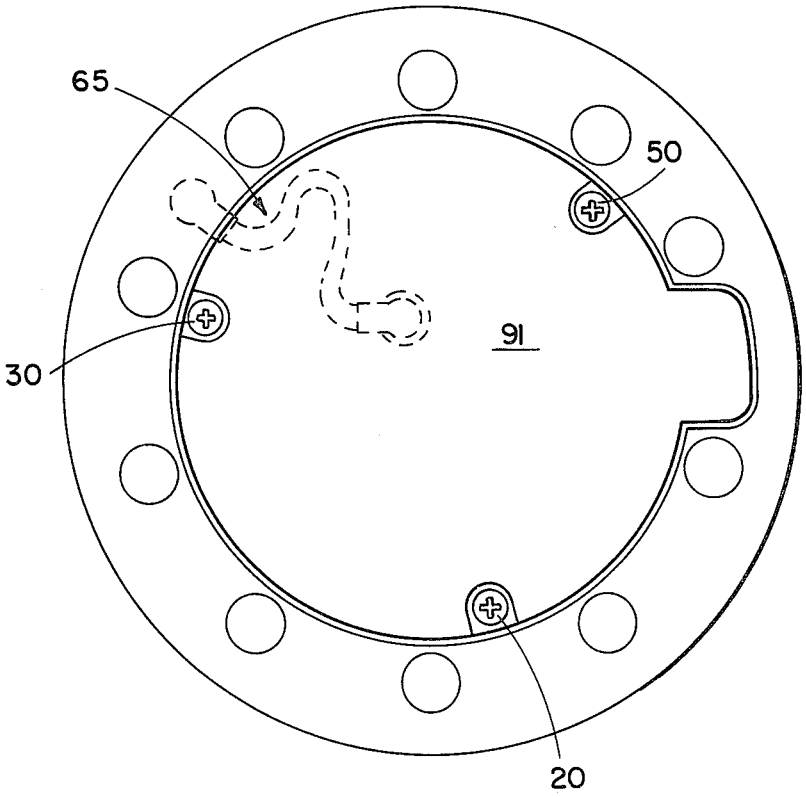
FIG. 5 is a bottom view of FIG. 1.

The removal of bolts 20, 30 and 50 as seen in FIG. 5 will allow the removal of cover 91. However, lug 22 and its bolt 59 as seen in FIG. 3 are positioned beneath the handle 71 when the handle 71 is in the stowed position depicted in full line in FIG. 3. Accordingly, the pump cannot be removed until the last bolt 59 is removed and this cannot be accomplished until the handle 71 has been pulled downwardly to the point where the valve sleeve 41 abuts the ring seal 46 and the key 82 clears the groove 83 and finally, the handle is turned to the position shown in dotted outline 71 in FIG. 3. When the key 82 has been withdrawn from the groove 83, and the shaft 76 has been angularly turned; the key engages the housing 12 to prevent spring return by the compressed spring 81.

It will be noted that the drain plug 19 only partially visible in FIG. 3 cannot be opened until the handle 71 has been pulled downward and turned as just described. This arrangement prevents the drain plug 19 from being removed from the pump until the closure sleeve valve 41 is in position to block fuel from tank 11 entering the pump cartridge housing 17. When the condition just described is present, the drain plug 19 may be removed to allow drainage of residual fuel from the pump housing.

Of incidental interest from the standpoint of the invention being described, but vital to safety, there are ground wire connections or straps provided and generally indicated by arrows 65,66 (FIGS. 3 and 5).

From the foregoing description, it is apparent that the fluid pump inlet closure valve and its actuating mechanism inherently provide for a sequence of manual operations which enhance the safety of plug-in cartridge pump removal and replacement while maintaining a compact, mechanically simple arrangement that is easy to operate and simple to maintain.

Although this invention has been illustrated and described in connection with the particular embodiment illustrated, it will be apparent to those skilled in the art that various changes may be made therein without departing from the spirit of invention as set forth in the appended claims.

I claim:

1. In a fluid holding receptacle, including in combination, a pump housing projecting into said fluid holding receptacle and integral therewith, said pump housing having an inlet opening to allow passage of fluid from said receptacle into said pump housing, a pump inlet closure valve sleeve positioned within said pump housing and mounted for movement in a predetermined path, a pump positioned within said pump closure valve sleeve, a valve sleeve actuating means having a handle pivotally secured to said pump housing and slideably moveable in a direction parallel to said predetermined path, said handle mechanically coupled to said valve sleeve and extending to block removal of said pump along said predetermined path, whereby initial manual movement of said handle causes said valve sleeve to move into a position blocking said inlet opening whereupon subsequent pivotal movement of said handle allows for the unobstructed passage of said pump from said housing.

2. The combination of claim 1 wherein said pivotally secured handle includes means to prevent pivotal movement before said handle has been manually moved to a position such that said pump closure sleeve valve blocks said inlet opening.

3. The combination of claim 2 including a biasing means positioned between a portion of said handle and said housing to thereby bias said handle towards said housing.

4. The combination of claim 3 wherein said biasing means is a spring, and said handle is slideably mounted on a shaft secured to said housing.

5. The combination of claim 1 wherein said pivotally secured handle includes a key means which slideably cooperates with a groove in said housing such that said key moves in such groove during sliding movement of said handle and said key is free of said groove during pivotal movement of said handle.

6. The combination of claim 1 wherein said pump includes a discharge port with a drain plug therein, and said handle is positioned in a manner such that access to said drain plug can only be obtained after said handle has been slideably moved and fully pivoted to thereby insure that said valve sleeve is in said inlet blocking position and that only residual fluid in said pump is allowed to escape should said drain plug be removed.

7. The combination of claim 1 which further includes a fixed ring stop member positioned between said pump and said housing; said ring stop member positioned in said path of the sleeve.

8. The combination of claim 7 wherein said ring stop member includes a seal between said ring stop member and said housing to thereby establish a pump housing seal.

9. The combination of claim 7 wherein said ring stop member is releasably secured to said housing.

10. The combination of claim 8 wherein said ring stop member having said pump housing seal is positioned within said housing such that when said valve sleeve is in said position blocking said inlet opening, said valve sleeve abuts said ring stop member.

11. The combination of claim 1 wherein said handle is mechanically coupled to said valve sleeve by a plurality of rods secured at one end to said valve sleeve; each rod having a head element at its other end.

12. The combination of claim 11 wherein said handle has at least one head element mechanical coupling to thereby secure said handle to one of said rods for sliding movement in unison.

13. The combination of claim 12 wherein said receptacle is a fuel tank.

14. The combination of claim 1 wherein said valve sleeve actuating means includes locking means to ensure said valve sleeve is in said position blocking said inlet opening before said pump can be removed.

15. The combination of claim 14 wherein said locking means includes on the pivotally secured handle a key means which slideably cooperates with a groove in said housing such that said key moves in said groove during sliding movement of said handle, and said key is free of said groove but abust a portion of said housing during pivotal movement of said handle whereby said actuating means and said valve sleeve is locked in position blocking said inlet opening during pivotal movement of said handle.

16. In an aircraft fuel tank with a pump mounted therein, in combination, a generally cylindrical pump housing projecting into said fuel tank and having a radially directed inlet for passage of fuel from said tank into said housing, a pump in a generally cylindrical pump cartridge positioned in said pump housing for removal from the housing exteriorly of the tank, a generally cylindrical valve sleeve positioned within said pump housing between the housing and the pump cartridge and mounted for axial movement between a valve open position in which said inlet is open to permit flow of fuel from the tank into the housing and a valve closed position in which the inlet is blocked to prevent flow of fuel from the tank into the housing, a valve sleeve actuating handle having a pivot shaft mounted on the housing for movement in a direction axially of the housing and angularly relative to the housing about a pivot axis at one side of the housing, means connecting the handle to the valve sleeve to move the valve sleeve axially when the handle is moved axially, means preventing angular movement of the handle in valve open position until the handle and the valve sleeve are moved to valve closed position, means connecting the handle to the valve sleeve to permit angular movement of the handle without angularly moving the sleeve and while retaining the sleeve in valve closed position, and means locating the handle to prevent removal of the pump when the valve sleeve is in valve open position and locating the handle to permit removal of the pump when the valve sleeve is in valve closed position.

17. The combination of claim 16 wherein there is included means biasing the handle in a direction to move the valve sleeve toward a valve open position.

18. The combination of claim 16 wherein there are included peripheral seals on the valve sleeve at axially spaced positions to engage the pump housing at opposite ends of the inlet when the valve sleeve is in the valve closed position.

19. The combination of claim 16 wherein there is included locking means to ensure said valve sleeve is in closed position before said pump can be removed.

20. The combination of claim 19 wherein said locking means includes a key means on said pivot shaft, said key means slidingly cooperates with a groove in said housing such that said key moves in said groove during axial movement of said handle and said key is free of said groove but abuts a portion of said housing during angular movement of said handle whereby said valve sleeve is locked in valve closed position during angular movement of said handle.

* * * * *